US005514509A

United States Patent [19]

Kawata et al.

[11] Patent Number: 5,514,509

[45] Date of Patent: May 7, 1996

[54] ELECTROPHOTOGRAPHIC DEVELOPER

[75] Inventors: Hideaki Kawata, Neyagawa; Nobuaki Kawano, Higashiosaka; Fumie Kimura, Ikoma; Seijiro Ishimaru, Ibaraki, all of Japan

[73] Assignee: Mita Industrial Co., Ltd., Japan

[21] Appl. No.: 957,680

[22] Filed: Oct. 7, 1992

[30] Foreign Application Priority Data

Oct. 8, 1991 [JP] Japan ..... 3-260654

[51] Int. Cl.[6] ..... G03G 9/10; G03G 9/113

[52] U.S. Cl. ..... 430/108; 430/106.6; 430/137

[58] Field of Search ..... 430/108, 106.6, 430/137

[56] References Cited

U.S. PATENT DOCUMENTS

| | | | |
|---|---|---|---|
| 4,504,563 | 3/1985 | Tanaka et al. | 430/109 |
| 4,518,727 | 5/1985 | Traver | 524/35 |
| 4,977,054 | 12/1990 | Honjo et al. | 430/106.6 |
| 5,079,124 | 1/1992 | Kawata et al. | 430/108 |

FOREIGN PATENT DOCUMENTS

| | | | |
|---|---|---|---|
| 0405503 | 2/1991 | European Pat. Off. . | |
| 60-6953 | 1/1985 | Japan . | |
| 62-229159 | 10/1987 | Japan | 430/108 |

OTHER PUBLICATIONS

Patent & Trademark English Translation of Japanese Patent 60–6953 (Pub. Jan. 14, 1985).

Database WPIL Derwent, AN 85–141038 relating to U.S. Pat. No. 4,518,727 to Traver, Apr. 21, 1985.

Patent Abstracts of Japan, vol. 9, No. 120 (P–358)(1843), May 24, 1985 to Nakayama JP 60–6953.

Patent Abstracts of Japan, vol. 11, No. 203 (P–591)(2650), Jul. 2, 1987 to Tosaka JP–62–24268.

Database WPIL Derwent AN 88–052965 relating to Japanese Patent Publication No. 63–008676, Jan. 14, 1988.

Patent Abstracts of Japan, vol. 8, No. 33 (P–254) to Takashi, Feb. 14, 1984 JP 58–189647.

*Primary Examiner*—Janis L. Dote

*Attorney, Agent, or Firm*—Beveridge, DeGrandi, Weilacher & Young

[57] ABSTRACT

An electrophotographic developer includes a toner and a carrier, in which the carrier is provided on the surface of a core material thereof with a resin coating layer. The coating layer is made of cured body of a methyl silicone resin containing not less than 70% by weight of T-units and a methylated melamine resin having a molecular weight of not less than 700. This developer is not lowered in flowability, generates no spent particles and presents stable electric charging characteristics. Accordingly, the developer of the present invention is suitably used where a toner is used containing no electric charge controlling agent.

14 Claims, No Drawings

ELECTROPHOTOGRAPHIC DEVELOPER

BACKGROUND OF THE INVENTION

The present invention relates to a two-component electrophotographic developer to be used for an image forming apparatus using a so-called electrophotographic method, such as an electrostatic copying apparatus, a laser beam printer or the like.

In the image forming apparatus above-mentioned, the surface of a photoreceptor is exposed to light to form an electrostatic latent image on the surface of the photoreceptor. By a developing device, an electrophotographic developer is allowed to come in contact with the surface of the photoreceptor. The powder toner contained in the developer is stuck to the electrostatic latent image, so that the electrostatic latent image is formed into a toner image. From the photoreceptor surface, the toner image is transferred to and fixed on the surface of paper. Thus, an image corresponding to the electrostatic latent image is completed on the paper surface.

As the developer, there is generally used a two-component developer containing a toner and a carrier which is adapted to give an electric charge to the toner by frictional charging and to supply the toner to the electrostatic latent image while adsorbing the toner.

As the carrier, there may be used magnetic particles such as iron powder, ferrite particles or the like. To control the toner electric charge amount and polarity, to improve the dependency on humidity, to prevent the occurrence of filming and to improve the flowability or the like, there is generally used a so-called coated carrier having a core material made of the magnetic particles above-mentioned and a resin coating layer formed on the surface of the core material.

A variety of resins such as thermoplastic and thermosetting resins may be used as the material of the resin coating layer. Of these, a cured body of a silicone resin is suitably used because it advantageously improves the flowability and prevents the filming phenomenon that crushed toner particles or the like stick, as spent particles, to the carrier surface (See Japanese Unexamined Patent Publication No. 186844/1985).

It has also been proposed that a resin coating layer made of any of a variety of resins such as a silicone resin or the like, contains a melamine resin to adjust the electric charging characteristics of the carrier in a suitable range (See Japanese Patent Publication No. 9946/1983, Japanese Unexamined Patent Publication No. 262057/1987 or the like).

However, even though a conventional coated carrier has a resin coating layer of a silicone resin, the carrier particles agglomerate to decrease the carrier in flowability or to generate spent particles. Further, even though the resin coating layer contains a melamine resin, the effect of adjusting the electric charging characteristics has not been sufficient.

On the other hand, the toner is generally produced by mixing a binder resin with a coloring agent and an electric charge controlling agent. The electric charge controlling agent comprises an electron imparting substance or an electron attractive substance to cause the toner to be negatively or positively electrically charged.

However, the electric charge controlling agent is disadvantageously liable to fall down from the toner surface due to its friction with the carrier in the developing step. The electric charge controlling agent falling down from the toner surface contaminates the carrier surface, provoking a decrease in the electric charging ability of the carrier. Further, toner particles from the surfaces of the electric charge controlling agent which fall down, are deteriorated in electric charging characteristics. Further, the electric charge controlling agent is often expensive, thus provoking an increase in toner production cost. Further, the electric charge controlling agent includes a few poisonous examples such as a metallic chelate compound using a metal such as chromium or the like.

Accordingly, it has long been desired to develop a toner containing no electric charge controlling agent. In this connection, Japanese Unexamined Patent Publication No. 280758/1987 discloses a toner in which a composition including a coloring agent and a binder resin as main components, contains a polymer including an acid group and having an acid value of not less than 100.

Further, U.S. Pat. No. 4,504,563 discloses a toner containing a vinyl-type copolymer of which the acid value is in the range from 5 to 100. This Patent discusses an invention proposed with the main object of preventing toner offset. From the description of embodiments of the invention, however, it seems that the invention is directed to a toner containing no electric charge controlling agent.

The toners above-mentioned are preferable in view of production cost or safety, but are not sufficiently satisfactory in view of the control of toner electric charge. This is because no consideration has been made on the relationship between a toner and a carrier exerting a great influence upon the electric charging characteristics of the toner.

It is a main object of the present invention to provide an electrophotographic developer which is not decreased in flowability and which generates no spent particles, thus assuring stable electric charging characteristics.

It is another object of the present invention to provide an electrophotographic developer particularly using a toner containing no electric charge controlling agent, so that the developer is improved in electric charging characteristics and developing characteristics.

SUMMARY OF THE INVENTION

The inventors of the present invention have studied the reason why conventional carriers were decreased in flowability and generated spent particles.

As a result, the inventors have found that, in a carrier having a resin coating layer of a silicone resin containing a melamine resin, the compatibility between the silicone and melamine resins is very low, thus decreasing the resin coating layer in surface uniformity.

More specifically, the conventional resin coating layer does not form a uniform phase due to low compatibility between both resins and presents a structure in which the melamine resin is dispersed, in the form of particle blocks, in the silicone resin. Further, the particle blocks of melamine resin are softer than silicone resin. Accordingly, when the developer is repeatedly stirred in a developing device, the particle blocks of melamine resin are liable to come off from the resin coating layer, thus lowering the resin coating layer in surface uniformity.

When the resin coating layer is lowered in surface uniformity, the surface energy is increased. This causes the carrier to readily agglomerate and generate spent particles. Further, it is a matter of course that the resin coating layer in which particle blocks of melamine resin come off is not stable in electric charging characteristics.

The inventors have found that the silicone resin itself contains a cause for the problems above-mentioned.

More specifically, when cured, the silicone resin forms a three-dimensional net-like structure. As this three-dimensional net-like structure is tighter, the resin coating layer is improved in surface uniformity and therefore becomes excellent in the effect of preventing agglomeration or generation of spent particles. However, there are instances where a conventionally prevailing silicone resin cannot form a sufficient three-dimensional net-like structure when it is cured. As a result, the resin coating layer is lowered in surface uniformity, causing the surface to be sticky. This readily causes the carrier particles to agglomerate, or generates spent particles. Further, a conventionally prevailing silicone resin contains, in molecules thereof, a group such as a phenyl group in a methyl phenyl silicone resin, which contributes to agglomeration and generation of spent particles. This is believed to be one of the causes for the problems above-mentioned.

In view of the foregoing, the inventors have studied the improvement of a resin coating layer in surface uniformity from two viewpoints, i.e., the characteristics of a silicone resin itself and the characteristics of a melamine resin to be contained therein.

Then, the inventors have found that a methyl silicone resin having no phenyl group or the like contributing to generation of spent particles, may be used out of a variety of silicone resins, and that there can be formed a cured body having a tighter three-dimensional net-like structure as the amount of T-unit or trifunctional unit ($RSiO_{1.5}$, wherein R represents a methyl group) contained in the methyl silicone resin is greater.

As to the melamine resin, the inventors have found the following. Even though a melamine resin is poor in compatibility with a silicone resin and is adapted to be dispersed, in the form of particle blocks, in a silicone resin, when a melamine resin having hardness substantially equal to that of a cured body of a silicone resin is used, such particle blocks do not come off from the resin coating layer to prevent the resin coating layer from being lowered in surface uniformity. It has been also found that, to increase the hardness of a melamine resin as above-mentioned, there may be selected the type and molecular weight range of the melamine resin.

The inventors have further studied the methyl silicone resin and the melamine resin, and now have accomplished the present invention.

Accordingly, the electrophotographic carrier of the present invention is characterized in that the carrier core material is provided on the surface thereof with a resin coating layer comprising a methyl silicone resin containing not less than 70% (by weight) of T-unit and a methylated melamine resin having molecular weight of not less than 700. The resin coating layer is produced by dissolving or dispersing each component constituting the resin coating layer in a solvent, to thereby prepare a carrier coating solution which is coated on the surface of a carrier core material, and then heat-treating the coated carrier core material to cure the resin.

When the carrier combined with a toner containing no electric charge controlling agent is used as a two-component developer, the developer is remarkably improved in electric charging characteristics and developing characteristics.

More specifically, studies were conventionally made exclusively on means for adjusting the acid value of a binder resin as mentioned earlier in order to obtain a high image density with the use of a toner containing no electric charge controlling agent. On the other hand, a normal carrier is liable to be increased in the amount of electric charge because a silicone resin is used in the coating layer in order to prevent the generation of spent particles. When such a carrier is combined with a toner containing no electric charge controlling agent, the amount of electric charge becomes unstable. The inventors have studied hard and found the following novel fact. That is, when there is used a developer obtained by combining a toner containing a coloring agent and a binder resin having an acid value of 3 to 40, with the carrier above-mentioned, the amount of electric charge is stabilized in the optimum range thereof, and the occurrence of fog and toner scattering are prevented, even though the developer uses the toner containing no electric charge controlling agent.

Also, the developer of the present invention is excellent in the ability of toner resupply and effectively prevents the generation of spent particles.

DETAILED DESCRIPTION OF THE INVENTION

The methyl silicone resin used in the present invention is obtainable by condensation-polymerizing a silanol compound obtained by hydrolyzing a mixture of, for example, methyltrichlorosilane, trimethylchlorosilane and dimethyldichlorosilane. A T-unit is determined by the amount of methyltrichlorosilane ($CH_3SiC_{13}$) contained in the mixture of methyltrichlorosilane, trimethylchlorosilane and dimethyldichlorosilane used in the reaction.

More specifically, to adjust the proportion of the T-unit in the methyl silicone resin as cured to not less than 70% (by weight), the blending proportion of methyltrichlorosilane, out of the starting materials of methylchlorosilanes, based on which the T-unit is determined, may be set to not less than 70% (by weight).

According to the present invention, the proportion of the T-unit in the methyl silicone resin is preferably not less than 70% (by weight) in order to form a cured body having a tight three-dimensional net-like structure. If the proportion of the T-unit is less than 70%, this relatively increases the proportion of a D-unit or bifunctional unit ($R_2SiO$) which does not contribute to crosslinking, or the proportion of a M-unit or a monofunctional unit ($R_3SiO_{0.5}$) which decreases the molecular weight ("R" in these formulae represents a methyl group). This fails to form a tight three-dimensional net-like structure, so that the carrier is liable to agglomerate or generate spent particles. With the generation of spent toner particles, the toner is decreased in the amount of electric charge to increase fog or toner scattering.

The upper limit of the proportion of the T-unit is not limited to a specific range, but can be optionally selected up to 100%.

As the melamine resin contained together with the methyl silicone resin in the resin coating layer, there is used a methylated melamine resin of which molecular weight (weight average molecular weight) is not less than 700.

If the molecular weight of the methylated melamine resin is less than 700, particle blocks of the methylated melamine resin dispersed in the methyl silicone resin are soft and present no sufficient hardness, as mentioned earlier. Accordingly, when the developer is repeatedly stirred in a developing device, these particle blocks are liable to fall off from the resin coating layer, causing the resin coating layer to be decreased in surface uniformity. Accordingly, the carrier is liable to agglomerate and generate spent particles, and is decreased in electric charging characteristics. Further, fog or toner scattering often occurs.

The upper limit of the molecular weight of the methylated melamine resin is not limited to a specific range, but is preferably not more than 2000. The weight-average molecular weight of the methylated melamine resin may be in the range from 700 to 2000.

The methylated melamine resin can be obtained in the manner that melamine is addition-reacted with formaldehyde to obtain a methylolated substance, which is then reacted with methanol, so that at least a portion of a methylol group is etherified (methylated). The proportion of formaldehyde used in the reaction is preferably in the range from 1.0 to 8.0 moles per 1 mole of melamine, and more preferably from 2.0 to 7.0 moles per 1 mole of melamine. The methylolation reaction is conducted in the presence of an alkali catalyst such as hydroxide of alkali metal or alkali earth metal, ammonia or the like. At the time of this reaction, the methylolated melamines are condensated; that is, the methylolated melamines are bonded to each other through a methylene group to increase the molecular weight. At this time, when methanol is present in the reaction catalyst, the methylol group is condensated with the methanol, thus provoking etherification. The degree of the etherification (methylation) is preferably in the range from 10 to 85% by mole and more preferably from 20 to 80% by mole.

The proportion of the methylated melamine resin in the resin coating layer of the cured body comprising the methyl silicone resin and the methylated melamine resin, is not limited to a specific range, but is preferably in the range from 5 to 70% by weight. If the proportion of the methylated melamine resin is less than 5% by weight, the effect to be produced by the addition of the methylated melamine resin is not sufficient. This involves the likelihood that the electric charging characteristics of the carrier becomes unstable. If the proportion of the methylated melamine resin is more than 70% by weight, the melamine is increased in self-crosslinking to lower the reactivity at the time of curing. This not only lowers the resin coating layer in film forming ability, but also causes the resin coating layer as cured to become fragile, so that the resin coating layer is liable to be separated from the carrier core material.

According to the present invention, the resin coating layer may also contain resins other than the methyl silicone resin and the methylated melamine resin, in such an amount as not to lower the resin coating layer in characteristics. Examples of the other resins include a variety of conventional resins to be used for coating a carrier, such as a (meth)acrylic polymer, a styrene polymer, a styrene-(meth)acrylic copolymer, an olefin polymer (polyethylene, chlorinated polyethylene, polypropylene or the like), polyvinyl chloride, polyvinyl acetate, polycarbonate, a cellulose resin, a polyester resin, an unsaturated polyester resin, a polyamide resin, a polyurethane resin, an epoxy resin, silicone resins other than a methyl silicone resin, a fluorine-containing resin (polytetrafluoroethylene, polychlorotrifuluoroethylene, polyvinylidene fluoride or the like), a phenol resin, a xylene resin, a diallyl phthalate resin, a polyacetal resin, amino resins other than a methylated melamine resin, and the like. These examples may be used singly or in combination of plural types.

As necessary, the resin coating layer may contain additives for adjusting the characteristics thereof such as silica, alumina, carbon black, fatty acid metallic salts and the like.

The thickness of the resin coating layer may be substantially the same as that of a conventional resin coating layer, and is not limited to a specific range. However, the thickness of the resin coating layer in terms of the amount of resin applied to the carrier core material, is preferably from 0.01 to 10% by weight and more preferably from 0.05 to 5% by weight with respect to the carrier core material.

Examples of the carrier core material having a surface coated with the resin coating layer, include a variety of conventional materials such as (i) particles of iron, oxidized iron, reduced iron, magnetite, copper, silicon steel, ferrite, nickel, cobalt and the like, (ii) particles of alloys of any of the metals above-mentioned with manganese, zinc, aluminum and the like, (iii) particles of an iron-nickel alloy, an iron-cobalt alloy and the like, (iv) particles obtainable by dispersing any of the particles above-mentioned in a binder resin, (v) particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, lithium niobate and the like, and (vi) particles of high-permittivity substances such as ammonium dihydrogen phosphate ($NH_4H_2PO_4$), potassium dihydrogen phosphate ($KH_2PO_4$), Rochelle salt and the like.

Of these, there are suitably used ferrite particles which are small in the rate of variations of the electric resistance due to environmental conditions and with the passage of time, and which can form a soft brush adapted to come in contact with the surface of a photoreceptor when a magnetic field is applied to the developer in a developing device. Examples of the ferrite particles include particles of zinc-type ferrite, nickel-type ferrite, copper-type ferrite, nickel-zinc-type ferrite, manganese-magnesium-type ferrite, copper-magnesium-type ferrite, manganese-zinc-type ferrite, manganese-copper-zinc-type ferrite and the like. Particularly, particles of the manganese-copper-zinc-type ferrite are preferable.

The particle size of the carrier core material is preferably in the range from 10 to 200 μm and more preferably from 30 to 150 μm. The saturated magnetization of the carrier core material is preferably from 35 to 70 emu/g and more preferably from 40 to 65 emu/g.

Likewise a conventional carrier, the electrophotographic carrier of the present invention is produced by dissolving or dispersing, in a suitable solvent, the components forming the resin coating layer such as a methyl silicone resin oligomer, a methylated melamine resin and the like to prepare a coating solution, and applying the coating solution thus prepared to the surface of the carrier core material, which is then heat-treated to cure the resins.

As a method of applying the coating solution to the surface of the carrier core material, there may be used a method of uniformly mixing the carrier core material and the coating solution with the use of a conventional mixer such as a V-type blender, a Nauter mixer or the like. In addition, there may also be used an immersing method, a spraying method, a fluidized bed method, a rolling bed method or the like.

Examples of the solvent to be used for preparing the coating solution include aromatic hydrocarbons such as toluene, xylene and the like; halogenated hydrocarbons such as trichloroethylene, perchloroethylene and the like; ketones such as acetone, methyl ethyl ketone and the like; cyclic ethers such as tetrahydrofuran and the like; and alcohols such as methanol, ethanol, isopropyl alcohol and the like.

The heat-treating temperature at which the resins are cured, is preferably not less than the temperature at which the methyl silicone resin substantially starts a curing reaction. More specifically, such a temperature is preferably in the range from 80° to 400° C. and more preferably from 100° to 300° C.

According to the present invention, the toner comprises a coloring agent and a binder resin of which the acid value is in the range from 3 to 40.

As the coloring agent, there can be used any of the coloring agents conventionally blended with a toner. Examples of the coloring agent include, in addition to carbon black, dyes and pigments of colors such as cyanogen, magenta, yellow and the like. The blending proportion of the coloring agent is in the range from 1 to 30 parts by weight and preferably from 1 to 20 parts by weight for 100 parts by weight of the binder resin.

As the binder resin, there can be used a copolymer of a polymerizable monomer having an acid group in molecules, and other monomer. Examples of the polymerizable monomer having an acid group in molecules, include acrylic acid, methacrylic acid, α-chloracrylic acid, α-bromacrylic acid, α-acylamide acrylic acid, α-benzamide acrylic acid, α-phenylacetamide acrylic acid, α-ethyl acrylic acid, crotonic acid and the like.

Examples of the other monomer above-mentioned include a variety of conventional vinyl-type monomers including styrenes such as styrene, chlorstyrene, α-methylstyrene and the like; monocarboxylates such as methyl methacrylate, ethyl methacrylate, methyl acrylate, ethyl acrylate, acryl n-butyl, dodecyl acrylate, 2-chlorethyl acrylate and the like; vinyl esters such as vinyl chloride, vinyl bromide, vinyl acetate, vinyl propionate, vinyl butyrate, vinyl benzoate and the like; derivatives of acrylic acid or meacrylic acid such as acrylonitrile, methacrylnitrile, acrylamide and the like; vinylnaphthalins; vinyl ketones such as vinyl methyl ketone, vinyl hexyl ketone and the like; N-vinyl compounds such as N-vinylpyrrole, N-vinylcarbazole, N-vinylindole, N-vinylpyrrolidene and the like. These monomers may be used singly or in combination of plural types.

At least one vinyl-type monomer and a polymerizable monomer having an acid group may be copolymerized by solution polymerization, block polymerization, suspension polymerization or dispersion polymerization. To impart a predetermined acid value to the binder resin thus obtained, the blending proportion of the vinyl-type monomer to the polymerizable monomer having an acid group can be so determined as to obtain the predetermined acid value. In a styrene-acrylic copolymer for example, resin having an acid value of 3 to 40 can be obtained by setting the blending proportion of the acrylic acid to the total monomers in the range from about 1 to 8% by mole.

The molecular weight of the resulting copolymer is preferably in the range from 50000 to 300000 in terms of weight average molecular weight (Mw) and in the range from 2000 to 20000 in terms of number average molecular weight (Mn). The glass transition point of the copolymer is preferably in the range from 50° to 70° C.

According to the present invention, the toner may contain, in addition to a coloring agent and a binder resin, a release agent such as a high molecular weight polyethylene, a low molecular weight polypropylene or the like, and other components. To improve the developer in flowability or the like, the toner and/or carrier may contain conventional external additives such as silica, alumina, tin oxide, strontium oxide, powders of a variety of resins and the like.

The toner thus produced can be used as mixed with the carrier at a proportion similar to that for a normal toner containing an electric charge controlling agent. The mixing proportion of the toner to the carrier is generally in the range from 2:98 to 10:90.

As discussed in the foregoing, the electrophotographic developer of the present invention is neither lowered in flowability, nor generates spent particles, and has stable electric charging characteristics. Thus, with the use of the developer of the present invention, stable images can be formed in a continuous image forming operation.

In particular, the developer of the present invention is most suitably used where there is used a toner containing no electric charge controlling agent. Further, the developer of the present invention has stable electric charging characteristics. Thus, with the use of the developer of the present invention, stable images can be formed in a continuous image forming operation.

Accordingly, the electrophotographic developer of the present invention can be suitably used for an image forming apparatus such as an electrostatic copying machine, a laser beam printer or the like.

EXAMPLES

The following description will discuss the electrophotographic developer of the present invention with reference to examples and comparative examples thereof. However, the present invention should not be limited to these examples.

Example 1

First, 1000 parts by weight of spheric ferrite particles having the average particle size of 80 μm as a carrier core material, were coated with 510 parts by weight of a coating agent comprising the following components which was sprayed to the carrier core material with the use of a fluidized bed coating device. The carrier core material thus coated was then heat-treated at 150° C. for one hour to prepare an electrophotographic carrier.

| *Coating agent | |
|---|---|
| Methyl silicone resin oligomer: (Proportion of T-unit: 87% (by weight) | 7 parts by weight |
| Methylated melamine resin: (Molecular weight: 700) | 3 parts by weight |
| Solvent (toluene): | 500 parts by weight |

Then, 96.5 parts by weight of the carrier thus obtained was mixed, under stirring, with 3.5 parts by weight of a toner comprising the following components to prepare a two-component developer. As to the toner, the average particle size was 11 μm, and the surface was treated with 0.2 part by weight of hydrophobic silica for 100 parts by weight of the toner.

| *Toner | |
|---|---|
| Fixing resin: (Styrene-acrylic copolymer) | 100 parts by weight |
| Carbon black: (MA-100 manufactured by Mitsubishi Kasei) | 10 parts by weight |
| Electric charge controlling agent: (a chromium-containing dye) | 1.5 part by weight |

Examples 2, 3 and Comparative Example 1

A developer was prepared in the same manner as in Example 1, except that there was used, as a component of the carrier coating agent, 3 parts by weight of each of methylated melamine resins of the which the molecular weights are shown in Table 1.

Comparative Examples 2 and 3

A developer was prepared in the same manner as in Example 1, except that there was used, as a component of the carrier coating agent, 3 parts by weight of each of butylated melamine resins of the which the molecular weights are shown in Table 1.

Comparative Example 4

A developer was prepared in the same manner as in Example 2, except that there was used, as a component of the carrier coating agent, 7 parts by weight of a methyl phenyl silicone resin oligomer instead of a methyl silicone resin oligomer.

Examples 4, 5 and Comparative Examples 5, 6

A developer was prepared in the same manner as in Example 2, except that there was used 7 parts by weight of each of the methyl silicone resin oligomers having the T-units shown in Table 1.

Comparative Example 7

A developer was prepared in the same manner as in Example 1, except that no methylated melamine resin was contained as a component of the carrier coating agent.

TABLE 1

| | Silicone Resin | | Melamine Resin | |
|---|---|---|---|---|
| | Type | T-unit (% by weight) | Type | Molecular Weight |
| Example 1 | Methyl | 87 | Methylated | 700 |
| Example 2 | Methyl | 87 | Methylated | 1100 |
| Example 3 | Methyl | 87 | Methylated | 1500 |
| Comparative Example 1 | Methyl | 87 | Methylated | 600 |
| Comparative Example 2 | Methyl | 87 | Butylated | 3500 |
| Comparative Example 3 | Methyl | 87 | Butylated | 5000 |
| Comparative Example 4 | Methyl-phenyl | — | Methylated | 1100 |
| Example 4 | Methyl | 75 | Methylated | 1100 |
| Example 5 | Methyl | 70 | Methylated | 1100 |
| Comparative Example 5 | Methyl | 60 | Methylated | 1100 |
| Comparative Example 6 | Methyl | 40 | Methylated | 1100 |
| Comparative Example 7 | Methyl | 87 | — | — |

With an electrostatic copying apparatus (DC-7085 manufactured by Mita Industrial Co., Ltd.) using (i) each of the developers above-mentioned as a start developer and (ii) the same toner as that contained in the start developer as a resupply toner, a document was continuously copied for 150,000 pieces. For each of the first copied piece and the 150,000th copied piece obtained with each of the developers, there were measured image density (I.D.) and fog density (F.D.) of the reproduced image, the amount of electric charge of the developer (μC/g) and the carrier spent rate of toner (%) after the continuous copying, by the following test methods.

Measurement of Image Density

With the use of a reflection densitometer (TC-6D manufactured by Tokyo Denshoku Company), there was measured the image density (I.D.) of the black solid portion of each reproduced image.

Measurement of Fog Density

With the use of the reflection densitometer above-mentioned, the density of the blank portion of each reproduced image was measured and determined as fog density (F.D.).

Measurement of Amount of Electric Charge of Developer

The amount of blow-off electric charge of each developer (μC/g) was measured with the use of a blow-off device manufactured by Toshiba Chemical Company.

Spent Rate

After the toner had been sucked and removed from each developer with which the 150,000-piece continuous copying operation had been finished, the weight of toner remaining on the carrier surface was measured with a carbon analyzer (manufactured by Horiba Company). The proportion of the toner weight to the carrier weight was calculated as a spent rate (%).

The test results are shown in Table 2.

TABLE 2

| | I.D. | | F.D. | | Amount of Electric Charge (μC/g) | | Spent |
|---|---|---|---|---|---|---|---|
| | 1st piece | 150,000th piece | 1st piece | 150,000th piece | 1st piece | 150,000th piece | Rate (%) |
| Example 1 | 1.37 | 1.38 | 0.002 | 0.002 | 23.8 | 24.3 | 0.24 |

TABLE 2-continued

| | I.D. | | F.D. | | Amount of Electric Charge (μC/g) | | Spent |
|---|---|---|---|---|---|---|---|
| | 1st piece | 150,000th piece | 1st piece | 150,000th piece | 1st piece | 150,000th piece | Rate (%) |
| Example 2 | 1.40 | 1.38 | 0.001 | 0.002 | 24.5 | 23.8 | 0.20 |
| Example 3 | 1.39 | 1.40 | 0.002 | 0.002 | 24.0 | 24.5 | 0.19 |
| Comparative Example 1 | 1.34 | 1.42 | 0.003 | 0.017 | 20.4 | 13.8 | 0.83 |
| Comparative Example 2 | 1.40 | 1.44 | 0.003 | 0.012 | 19.4 | 15.0 | 0.55 |
| Comparative Example 3 | 1.42 | 1.43 | 0.004 | 0.006 | 17.0 | 18.2 | 0.38 |
| Comparative Example 4 | 1.43 | 1.44 | 0.005 | 0.009 | 15.3 | 14.7 | 0.51 |
| Example 4 | 1.39 | 1.40 | 0.002 | 0.003 | 24.3 | 23.2 | 0.25 |
| Example 5 | 1.36 | 1.40 | 0.001 | 0.004 | 23.2 | 21.8 | 0.30 |
| Comparative Example 5 | 1.40 | 1.44 | 0.003 | 0.015 | 21.0 | 14.8 | 0.60 |
| Comparative Example 6 | — | — | — | — | — | — | — |
| Comparative Example 7 | 1.01 | 0.87 | 0.001 | 0.001 | 32.5 | 38.3 | 0.16 |

It is understood from the results shown in Table 2 that, in each of Comparative Example 1 using a methylated melamine resin having a molecular weight less than 700, Comparative Examples 2, 3 using a butylated melamine resin instead of a methylated melamine resin and Comparative Example 4 using a methylphenyl silicone resin as a silicone resin, a great amount of spent particles were generated in the 150,000-piece continuous copying operation, so that the amount of electric charge was considerably lowered to generate fog.

On the other hand, in each of the developers of Examples 1 to 3 containing no melamine resin in the carrier, a great amount of spent particles were not generated even in the 150,000-piece continuous copying operation, as in Comparative Example 7 having a uniform resin coating layer. Each electrophotographic carrier of Examples 1 to 3 presented stable electric charging characteristics throughout the copying operation from the image-forming starting time up to the image-forming ending time, as compared with Comparative Example 7 containing no methylated melamine resin. Accordingly, with each electrophotographic carrier of Examples 1 to 3, stable images could be formed up to the completion of the 150,000-piece continuous copying operation.

In the electrophotographic carrier of Comparative Example 5 in which the proportion of T-unit of the methyl silicone resin was less than 70% (by weight), a great amount of spent particles were generated in the 150,000-piece continuous copying operation. This remarkably lowered the amount of electric charge to generate fog, and toner scattering was noticeable.

In the electrophotographic carrier of Comparative Example 6 in which the proportion of T-unit was remarkably low, the carrier particles agglomerated to prevent the carrier from being used for image forming. Thus, the carrier of Comparative Example 6 could not be measured as to the characteristics above-mentioned.

On the other hand, in each of the electrophotographic carriers of Examples 4, 5, a great amount of spent particles were not generated in the 150,000-piece continuous copying operation, so that image forming could be carried out in a stable manner up to the completion of continuous copying.

Example 6

First, 1000 parts by weight of spheric ferrite particles having the average particle size of 80 μm as a carrier core material were coated with 510 parts by weight of a coating agent comprising the following components which were sprayed to the carrier core material with the use of a fluidized bed coating device. The carrier core material thus coated was then heat-treated at 200° C. for one hour to prepare an electrophotographic carrier.

| *Coating agent | |
|---|---|
| Methyl silicone resin oligomer: (Proportion of T-unit: 87% (by weight) | 7 parts by weight |
| Methylated melamine resin: (Molecular weight: 1100) | 3 parts by weight |
| Solvent (toluene): | 500 parts by weight |

The following toner components were mixed, molten and kneaded, and then cooled, crushed and classified to prepare particles having the average size of 11 μm. Then, the particles thus prepared were treated at the surfaces thereof with 0.2 part by weight of hydrophobic silica for 100 parts by weight of the particles, thus preparing a toner.

| *Toner Components | |
|---|---|
| Styrene-acrylic copolymer: (Acid value: 3) | 100 parts by weight |
| Carbon black: | 10 parts by weight |

Preparation of Developer

Then, 96.5 parts by weight of the carrier and 3.5 parts by weight of the toner were mixed under stirring to prepare a two-component developer.

Example 7

A two-component developer was prepared in the same manner as in Example 6, except for the use of a styrene-acrylic copolymer (acid value: 25) as the toner resin component.

Example 8

A two-component developer was prepared in the same manner as in Example 6, except for the use of a styrene-acrylic copolymer (acid value: 40) as the toner resin component.

Example 9

A two-component developer was prepared in the same manner as in Example 6, except for the use of the toner used in Example 7 and the use of resin in which the proportion of T-unit was 75% (by weight), as the methyl silicone resin in the carrier coating agent.

Example 10

A two-component developer was prepared in the same manner as in Example 6, except for the use of the toner used in Example 7 and the use of resin having a molecular weight of 700, as the methylated melamine resin in the carrier coating agent.

Comparative Example 8

A two-component developer was prepared in the same manner as in Example 6, except for the use of a styrene-acrylic copolymer (acid value: 0) as the toner resin component.

Comparative Example 9

A two-component developer was prepared in the same manner as in Example 6, except for the use of a styrene-acrylic copolymer (acid value: 60) as the toner resin component.

Comparative Example 10

A two-component developer was prepared in the same manner as in Example 6, except for the use of the toner used in Example 7 and the use of a methyl phenyl silicone resin instead of the methyl silicone resin in the carrier coating agent.

Comparative Example 11

A two-component developer was prepared in the same manner as in Example 6, except for the use of the toner used in Example 7 and the use of a styrene-acrylic copolymer resin instead of the methyl silicone resin in the carrier coating agent.

Comparative Example 12

A two-component developer was prepared in the same manner as in Example 6, except for the use of the toner used in Example 7 and the use of resin in which the proportion of T-unit was 60% (by weight), as the methyl silicone resin in the carrier coating agent.

Comparative Example 13

A two-component developer was prepared in the same manner as in Example 6, except for the use of the toner used in Example 7 and the use of resin having a molecular weight of 600, as the methylated melamine resin in the carrier coating agent.

Comparative Example 14

A two-component developer was prepared in the same manner as in Example 6, except for the use of the toner used in Example 7 and the use of a methyl silicone resin alone as the carrier coating agent.

Table 3 shows the acid values of binder resins contained in the toners used in Examples 6 to 10 and Comparative Examples 8 to 14, and the details of the resins used in the carrier coating agent.

TABLE 3

| | Acid Value of Binder Resin in Toner | Resin Coating Layer of Carrier: Resin 1 Type | Resin 1 T-Unit (% by weight) | Resin 2 Type | Resin 2 Molecular Weight |
|---|---|---|---|---|---|
| Ex. 6 | 6 | Methyl silicone | 87 | Methylated melamine | 1100 |
| Ex. 7 | 25 | Methyl silicone | 87 | Methylated melamine | 1100 |
| Ex. 8 | 40 | Methyl silicone | 87 | Methylated melamine | 1100 |
| Ex. 9 | 25 | Methyl silicone | 75 | Methylated melamine | 1100 |
| Ex. 10 | 25 | Methyl silicone | 87 | Methylated melamine | 700 |
| Com. Ex. 8 | 0 | Methyl silicone | 87 | Methylated melamine | 1100 |
| Com. Ex. 9 | 60 | Methyl silicone | 87 | Methylated melamine | 1100 |
| Com. Ex. 10 | 25 | Methyl phenyl silicone | — | Methylated melamine | 1100 |
| Com. Ex. 11 | 25 | Styrene acryl | — | Methylated melamine | 1100 |
| Com. Ex. 12 | 25 | Methyl silicone | 60 | Methylated melamine | 1100 |
| Com. Ex. 13 | 25 | Methyl silicone | 87 | Methylated melamine | 600 |

TABLE 3-continued

| | Acid Value of Binder Resin in Toner | Resin Coating Layer of Carrier: Resin 1 Type | Resin 1 T-Unit (% by weight) | Resin 2 Type | Resin 2 Molecular Weight |
|---|---|---|---|---|---|
| Com. Ex. 14 | 25 | Methyl silicone | 87 | — | |

"Ex." stands for "Example" and "Com. Ex." stands for Comparative Example.

Evaluation of the Developers

With an electrostatic copying apparatus (DC-7085 manufactured by Mita Industrial Co., Ltd.) using (i) each of the developers of Examples 6 to 10 and Comparative Examples of 8 to 14 as a start developer and (ii) the same toner as that contained in the start developer as a resupply toner, a document was continuously copied for 150,000 pieces. For each of the first copied piece and the 150,000th copied piece obtained with each of the developers above-mentioned, there were measured image density (I.D.) and fog density (F.D.) of the reproduced image, the amount of electric charge of the developer (μC/g) and the carrier spent rate of toner (%) after the continuous copying.

The test results are shown in Table 4.

TABLE 4

| | I.D. 1st piece | I.D. 150,000th piece | F.D. 1st piece | F.D. 150,000th piece | Amount of Electric Charge (μC/g) 1st piece | Amount of Electric Charge (μC/g) 150,000th piece | Spent |
|---|---|---|---|---|---|---|---|
| Example 6 | 1.42 | 1.39 | 0.003 | 0.002 | 22.5 | 24.1 | 0.21 |
| Example 7 | 1.40 | 1.38 | 0.001 | 0.004 | 24.3 | 26.0 | 0.35 |
| Example 8 | 1.38 | 1.36 | 0.002 | 0.003 | 23.0 | 24.6 | 0.28 |
| Example 9 | 1.38 | 1.40 | 0.002 | 0.004 | 23.3 | 22.4 | 0.43 |
| Example 10 | 1.39 | 1.42 | 0.003 | 0.003 | 23.8 | 23.5 | 0.36 |
| Comparative Example 8 | 1.41 | 0.95 | 0.002 | 0.001 | 23.8 | 38.4 | 0.16 |
| Comparative Example 9 | — | — | — | — | — | — | — |
| Comparative Example 10 | 1.44 | 1.46 | 0.004 | 0.011 | 24.4 | 18.3 | 0.96 |
| Comparative Example 11 | 1.42 | 1.46 | 0.002 | 0.018 | 25.0 | 13.4 | 1.40 |
| Comparative Example 12 | 1.40 | 1.47 | 0.003 | 0.015 | 22.5 | 16.8 | 1.02 |
| Comparative Example 13 | 1.43 | 1.46 | 0.003 | 0.013 | 21.0 | 15.5 | 1.22 |
| Comparative Example 14 | 1.36 | 1.18 | 0.002 | 0.003 | 26.2 | 33.0 | 0.18 |

As to Comparative Example 9, toner blocking occurred to deteriorate the toner resupply performance. Accordingly, the image density, the fog density and the like could not be evaluated for Comparative Example 9. As to Comparative Example 11, a great amount of toner scattered, so that the continuous copying operation was stopped at the 50,000th piece.

It is understood from the results of Table 4 that, for a developer using a toner containing no electric charge controlling agent, the amount of electric charge of the developer after the continuous copying operation was increased to lower the image density, similar to the situation when the acid value of resin in the toner was 0, as in Comparative Example 8. On the other hand, when the acid value of resin in the toner was high as in Comparative Example 9, the moisture-absorption characteristics became high to provoke toner blocking, thus preventing the toner from being smoothly resupplied.

Even though the acid value of the resin in the toner was proper, the spent rate was increased to generate toner scattering and fog if other silicone resin than a methyl silicone resin was used in the carrier coating agent.

On the other hand, as to the developer of each of Examples 6 to 10, the toner resupply performance was good, the generation of spent particles was restrained and the amount of electric charge was stabilized in the optimum range. Accordingly, with each developer of Examples 6 to 10, high image density was obtained and fog or toner scattering was hardly observed.

What is claimed is:

1. A two-component electrophotographic developer comprising a toner and a carrier, said carrier including a core material with a cured resin coating on a surface thereof, the resin coating consisting essentially of a methyl silicone resin and a methylated melamine resin, the methyl silicone resin including not less than 70% by weight of R—Si—$O_{1.5}$ units based on a total content of R—Si—$O_{1.5}$ units, $R_2SiO$ units and $R_3SiO_{0.5}$ units in the methyl silicone resin, wherein R represents a methyl group, and wherein the methylated melamine resin has a weight-average molecular weight of not less than 700.

2. A developer according to claim 1, wherein the weight-average molecular weight of the methylated melamine resin is in the range from 700 to 2000.

3. A developer according to claim 1, wherein the proportion of the methylated melamine resin in the resin coating is in the range from 5 to 70% by weight.

4. An electrophotographic developer comprising:

a toner containing a coloring agent and a binder resin, said binder resin having an acid value of 3 to 40; and a carrier, said carrier including a core material with a cured resin coating on a surface thereof, the resin coating consisting essentially of a methyl silicone resin and a methylated melamine resin, the methyl silicone resin including not less than 70% by weight of R—Si—$O_{1.5}$ units based on a total content of R—Si—$O_{1.5}$ units, $R_2SiO$ units and $R_3SiO_{0.5}$ units in the methyl silicone resin, wherein R represents a methyl group, and wherein the methylated melamine resin has a weight-average molecular weight of not less than 700.

5. A developer according to claim 4, wherein the toner contains no electric charge controlling agent.

6. A developer according to claim 4, wherein the binder resin in the toner is a vinyl containing copolymer including a monomer having an acid group.

7. A two-component electrophotographic developer comprising a toner and a carrier, said carrier including a core material with a resin coating on a surface thereof, the resin coating consisting essentially of a methyl silicone resin and a methylated melamine resin, the methyl silicone resin including not less than 70% by weight of R—Si—$O_{1.5}$ units based on a total content of R—Si—$O_{1.5}$ units, $R_2SiO$ units and $R_3SiO_{0.5}$ units in the methyl silicone resin, wherein R represents a methyl group, wherein the methylated melamine resin has a weight-average molecular weight of not less than 700, and wherein the carrier is produced by dissolving or dispersing the methyl silicone resin and the methylated melamine resin in a solvent to thereby form a carrier coating solution, coating the carrier coating solution on the surface of the core material, and curing the resin coating.

8. A developer according to claim 7, wherein the weight-average molecular weight of the methylated melamine resin is in the range from 700 to 2000.

9. A developer according to claim 7, wherein the proportion of the methylated melamine resin in the resin coating is in the range from 5 to 70% by weight.

10. A developer according to claim 7, wherein the curing of the resin coating includes a heat treatment step.

11. An electrophotographic developer comprising:

a toner containing a coloring agent and a binder resin, said binder resin having an acid value of 3 to 40; and a carrier, said carrier including a core material with a resin coating layer on a surface thereof, the resin coating layer consisting essentially of a methyl silicone resin and a methylated melamine resin, the methyl silicone resin including not less than 70% by weight of R—Si—$O_{1.5}$ units based on a total content of R—Si—$O_{1.5}$ units, $R_2SiO$ units and $R_3SiO_{0.5}$ units in the methyl silicone resin, wherein R represents a methyl group, wherein the methylated melamine resin has a weight-average molecular weight of not less than 700, and wherein the carrier is produced by dissolving or dispersing the methyl silicone resin and the methylated melamine resin in a solvent to thereby form a carrier coating solution, coating the carrier coating solution on the surface of the core material, and curing the resin coating layer.

12. A developer according to claim 11, wherein the toner contains no electric charge controlling agent.

13. A developer according to claim 11, wherein the binder resin in the toner is a vinyl containing copolymer including a monomer having an acid group.

14. A developer according to claim 11, wherein the curing of the resin coating layer includes a heat treatment step.

* * * * *